US009139387B2

(12) United States Patent
Inoue

(10) Patent No.: US 9,139,387 B2
(45) Date of Patent: Sep. 22, 2015

(54) SHEET FEEDING APPARATUS AND IMAGE FORMING APPARATUS

(71) Applicant: CANON KABUSHIKI KAISHA, Tokyo (JP)

(72) Inventor: Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/950,394

(22) Filed: Jul. 25, 2013

(65) Prior Publication Data

US 2014/0054847 A1 Feb. 27, 2014

(30) Foreign Application Priority Data

Aug. 23, 2012 (JP) ..... 2012-184434

(51) Int. Cl.

| | |
|---|---|
| ***B65H 3/52*** | (2006.01) |
| ***B65H 3/06*** | (2006.01) |
| ***G03G 15/00*** | (2006.01) |
| *B65H 27/00* | (2006.01) |

(52) U.S. Cl.

CPC ..... *B65H 3/5261* (2013.01); *B65H 3/0607* (2013.01); *B65H 3/0638* (2013.01); *B65H 3/0669* (2013.01); *G03G 15/6511* (2013.01); *B65H 27/00* (2013.01); *B65H 2402/631* (2013.01); *B65H 2403/512* (2013.01); *B65H 2403/732* (2013.01); *B65H 2404/17* (2013.01); *B65H 2404/192* (2013.01); *B65H 2601/524* (2013.01)

(58) Field of Classification Search

CPC ..... B65H 27/00; B65H 2401/2311; B65H 2402/35; B65H 2402/34; B65H 2402/341; B65H 2402/631; B65H 2403/10

USPC ..... 271/121

See application file for complete search history.

(56) References Cited

U.S. PATENT DOCUMENTS

| | | | |
|---|---|---|---|
| 5,358,230 | A | 10/1994 | Ikemori et al. |
| 5,485,991 | A | 1/1996 | Hirano et al. |
| 5,793,399 | A | 8/1998 | Kawakami et al. |
| 5,886,729 | A | 3/1999 | Hiramatsu et al. |
| 5,992,993 | A | 11/1999 | Kiyohara et al. |
| 6,045,220 | A | 4/2000 | Kiyohara et al. |

(Continued)

FOREIGN PATENT DOCUMENTS

| | | | | |
|---|---|---|---|---|
| JP | 58082933 | A | * | 5/1983 |
| JP | S61-90935 | A | | 5/1986 |

(Continued)

*Primary Examiner* — Howard Sanders

(74) *Attorney, Agent, or Firm* — Fitzpatrick, Cella, Harper & Scinto

(57) ABSTRACT

There are provided a sheet feeding apparatus which, with a simple configuration, can suppress generation of noise during feeding of a sheet without having an affect on sheet separating performance, and an image forming apparatus which includes this sheet feeding apparatus. The sheet feeding apparatus includes: a feeding roller which feeds a sheet S; a separation roller which is pressed against the feeding roller and rotates in a reverse direction to a direction of feeding by the feeding roller to separate sheets, fed by the sheet feeding apparatus, one by one; a feeding rotational shaft which transmits rotational driving force to the feeding roller; and a roller dumper which is provided between the feeding roller and the feeding rotational shaft, and transmits the rotational driving force from the feeding rotational shaft to the feeding roller, while absorbing vibrations of the feeding roller.

15 Claims, 9 Drawing Sheets

(56) References Cited

U.S. PATENT DOCUMENTS

| | | | | |
|---|---|---|---|---|
| 7,048,271 | B2 * | 5/2006 | Sheng et al. | 271/121 |
| 7,497,433 | B2 * | 3/2009 | Nagao | 271/125 |
| 8,292,293 | B2 | 10/2012 | Inoue | |
| 8,480,081 | B2 | 7/2013 | Inoue | |
| 8,550,456 | B2 | 10/2013 | Hirota et al. | |
| 2003/0160379 | A1 * | 8/2003 | Shimamura et al. | 271/10.01 |

FOREIGN PATENT DOCUMENTS

| | | | |
|---|---|---|---|
| JP | H07-172601 | A | 7/1995 |
| JP | H11-59941 | A | 3/1999 |
| JP | 2003-160243 | A | 6/2003 |
| JP | 2007-015792 | A | 1/2007 |
| JP | 4593389 | B2 | 12/2010 |
| JP | 2011-251807 | A | 12/2011 |

* cited by examiner

SHEET FEEDING APPARATUS AND IMAGE FORMING APPARATUS

BACKGROUND OF THE INVENTION

1. Field of the Invention

The present invention relates to a sheet feeding apparatus which feeds a sheet, and an image forming apparatus including the sheet feeding apparatus.

2. Description of the Related Art

There has hitherto been known an image forming apparatus including a sheet feeding apparatus which automatically feeds sheets, stored in a sheet tray for storing sheets, one by one toward an image forming portion. The sheet feeding apparatus is provided with a feeding roller for feeding the uppermost sheet stored in the sheet tray, and a separation roller for separating sheets being multiply fed. By means of the feeding roller and the separation roller, the apparatus separates the sheets, stored in the sheet tray, one by one and feeds each separated sheet to the image forming portion.

For separation of the sheets, the separation roller is pressed against the feeding roller, while being applied via a torque limiter with rotational drive to rotate in a reverse direction to a feeding direction. Therefore, for example, when two or more sheets are fed by the feeding roller, since friction force between the sheets is smaller than friction force between the separation roller and the sheet, the separation roller rotates in the reverse direction to the feeding direction, to bring back second and subsequent sheets. On the other hand, when one sheet is fed by the feeding roller, rotational drive is blocked off by the torque limiter, and the separation roller rotates as driven by the feeding roller, to feed the sheet.

However, after the second and subsequent sheets have been brought back by the separation roller, the separation roller may be pulled by the first sheet and may thus repeat the aforementioned reverse rotation and driven rotation. When these rotational operations are repeated at a high speed, vibrations of the feeding roller and the like might be generated to cause generation of noise.

In order to deal with this, there has been proposed a sheet feeding apparatus in which a pressing member is pressed against a rotational shaft of the feeding roller to suppress vibrations so as to reduce generation of noise during feeding of sheets (refer to Japanese Patent Laid-Open No. 2003-160243).

Moreover, there has been proposed a configuration in which a sheet guide is movably provided in a projecting position where a sheet is guided between a feeding roller and a pair of conveying rollers and in a retreat position where feeding of sheets is not prevented (refer to Japanese Patent Laid-Open No. 2011-251807). According to this configuration, the sheet guide is moved to the projecting position when a sheet is pulled out by the conveying roller, thereby to switch a sheet conveying direction so as to reduce vibrations.

However, in the case of pressing the pressing member against the rotational shaft of the feeding roller to suppress vibrations, there is required a large-sized driving motor serving to increase a driving torque for driving the feeding roller so that an extra load is generated at the rotational shaft. Moreover, in the case of switching the sheet conveying direction at the time of pulling out the sheet to suppress vibrations, a switching mechanism for switching the conveying direction is required, which has been problematic.

Accordingly, it is desirable to provide a sheet feeding apparatus which, with a simple configuration, can suppress generation of noise during feeding of sheets without having an affect on sheet separating performance, and an image forming apparatus which includes this sheet feeding apparatus.

SUMMARY OF THE INVENTION

According to the present invention, there is provided a sheet feeding apparatus including: a feeding roller which feeds a sheet; a separation roller which is pressed against the feeding roller and rotates in a reverse direction to a direction of feeding by the feeding roller to separate sheets, fed by the sheet feeding apparatus, one by one; a feeding rotational shaft which transmits rotational driving force to the feeding roller; and a vibration absorbing member which is provided between the feeding roller and the feeding rotational shaft, and transmits the rotational driving force from the feeding rotational shaft to the feeding roller, while absorbing vibrations of the feeding roller.

According to the present invention, it is possible to provide a sheet feeding apparatus in which a vibration absorbing member is provided between a feeding roller and a feeding rotational shaft and which, with the simple configuration, can suppress generation of noise during feeding of sheets without having an affect on sheet separating performance, and provide an image forming apparatus which includes this sheet feeding apparatus.

Further features of the present invention will become apparent from the following description of exemplary embodiments with reference to the attached drawings.

DESCRIPTION OF THE EMBODIMENTS

Hereinafter, an image forming apparatus including a sheet conveying portion according to each of embodiments of the present invention will be described with reference to the drawings. The image forming apparatus according to each of the embodiments of the present invention is an image forming apparatus including a sheet feeding apparatus which separates sheets one by one, such as a copying machine, a printer, a facsimile machine, and a complex apparatus of these. In each of the following embodiments, a description will be given using an electrophotographic image forming apparatus (hereinafter simply referred to as "image forming apparatus").

First Embodiment

Figure 1:
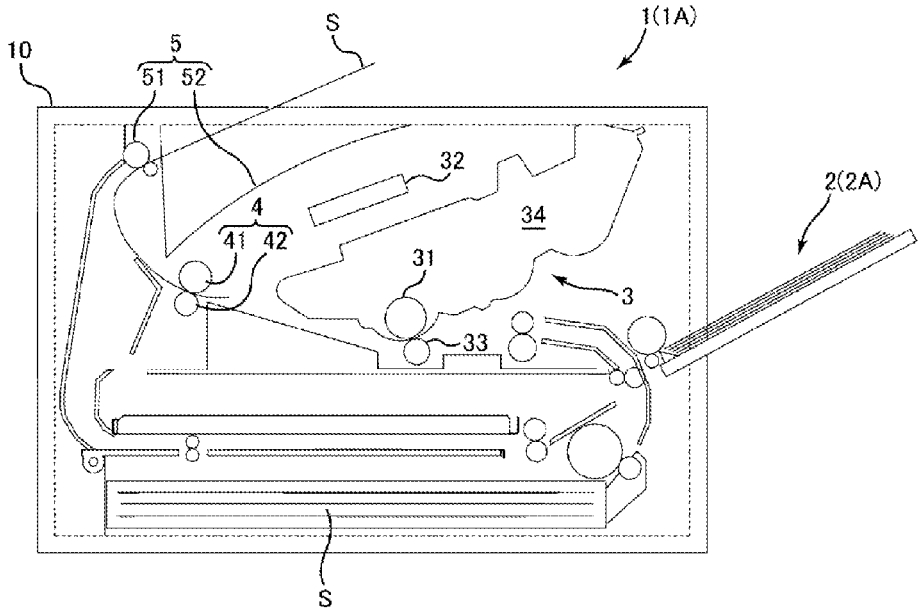
FIG. 1 is a sectional view schematically illustrating an overall structure of an image forming apparatus according to an embodiment of the present invention.

An image forming apparatus 1 according to a first embodiment of the present invention will be described with reference to FIGS. 1 to 6A to 6D. First, a schematic configuration of the image forming apparatus 1 according to the first embodiment will be described with reference to FIG. 1. FIG. 1 is a sectional view schematically illustrating an overall structure of the image forming apparatus 1 according to the embodiment of the present invention.

As illustrated in FIG. 1, the image forming apparatus 1 includes a sheet feeding apparatus 2 which feeds a sheet S, an image forming portion 3 which forms an image on the sheet S, a fixing portion 4 which fixes an image on the sheet S, and a discharge portion 5 which discharges the sheet S fixed with the image.

The sheet feeding apparatus 2 separates sheets one by one, and feeds each separated sheet to the image forming portion 3. It is to be noted that the sheet feeding apparatus 2 will be described in detail later.

The image forming portion 3 is provided downstream of the sheet feeding apparatus 2 in a sheet feeding direction (hereinafter simply referred to as "downstream"), and includes a photosensitive drum 31 which forms a toner image, and a charger (not illustrated) which uniformly charges the surface of the photosensitive drum 31. Further, the image forming portion 3 includes an exposure portion 32 which irradiates the photosensitive drum 31 with laser light to form an electrostatic latent image thereon, a developing portion (not illustrated) which visualizes the electrostatic latent image on the photosensitive drum 31 as a toner image, and a cleaning portion (not illustrated) which collects the residual toner. Moreover, the image forming portion 3 is provided with a transfer roller 33 which is pressed against the photosensitive drum 31 to form a transfer nip. It should be noted that in the present embodiment, the photosensitive drum 31, the charger, the developing portion and the cleaning portion are unitized, and then detachably configured in an apparatus body 10 as a process cartridge 34.

The fixing portion 4 is provided downstream of the image forming portion 3 in a sheet conveying direction (hereinafter simply referred to as "downstream"), and includes a fixing roller 41 having a heater built therein, and a pressure roller 42 which is pressed against the fixing roller 41. The discharge portion 5 is provided downstream of the fixing portion 4, and includes a pair of discharge rollers 51 which discharge a sheet from the inside of the apparatus body, and a discharge tray 52 which loads the discharged sheets.

Figure 2:
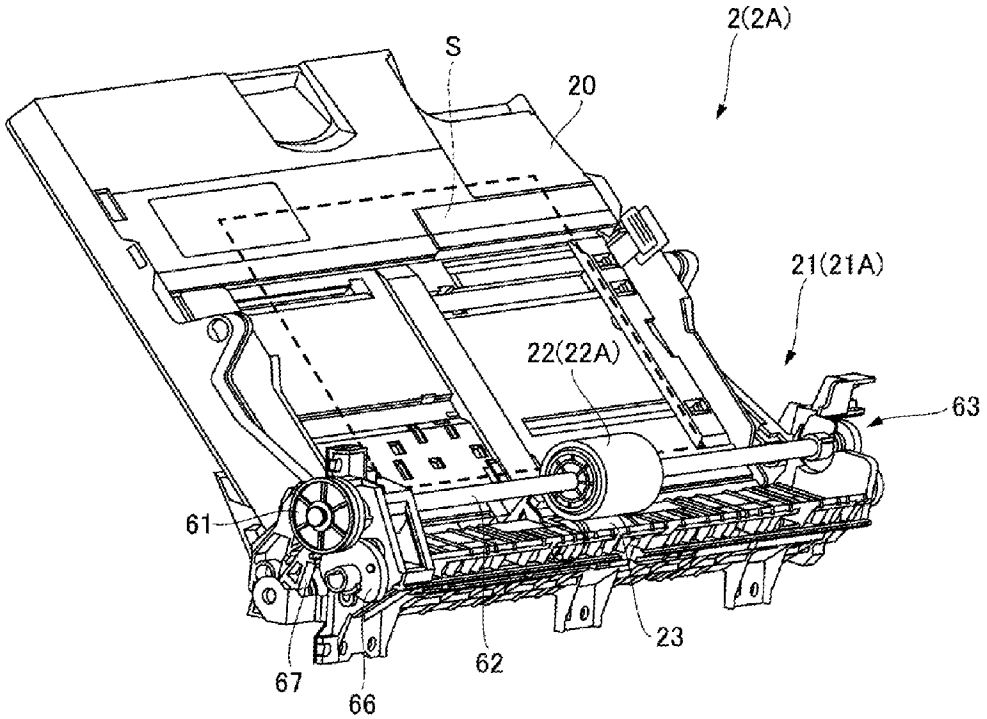
FIG. 2 is a perspective view illustrating a sheet feeding apparatus according to the present embodiment.
Figure 3:
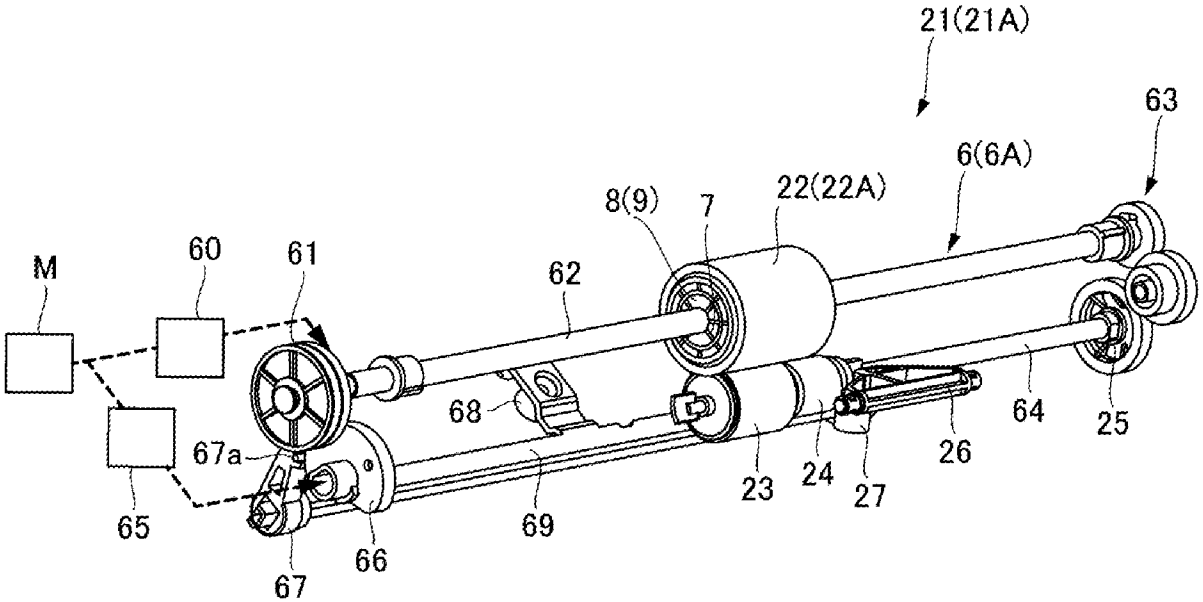
FIG. 3 is a perspective view illustrating a separation feeding unit in a sheet feeding apparatus according to the present embodiment.
Figure 4:
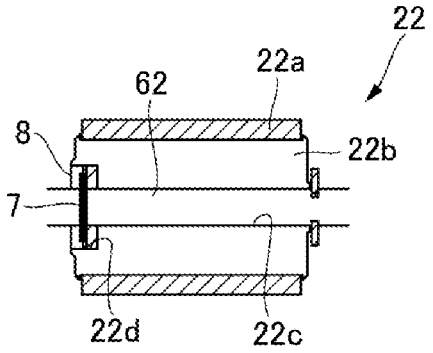
FIG. 4 is a sectional view of a feeding roller in a sheet feeding apparatus according to a first embodiment.
Figure 5A:
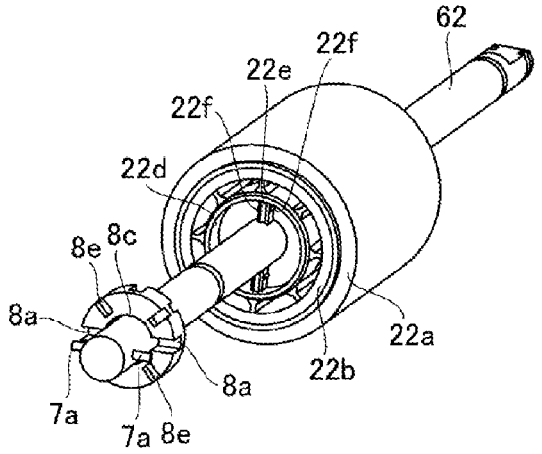
FIGS. 5A and 5B are perspective views illustrating a roller dumper in a sheet feeding apparatus according to the first embodiment.
Figure 5B:
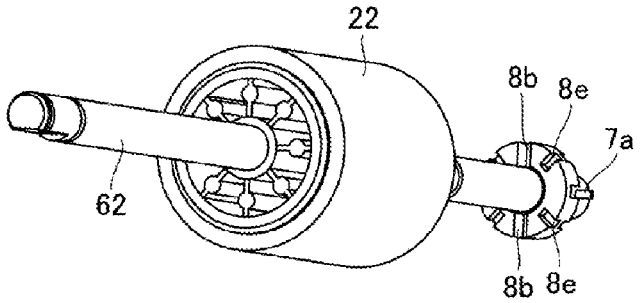

Subsequently, the sheet feeding apparatus 2 according to the first embodiment will be specifically described with reference to FIGS. 2 to 5A and 5B in addition to FIG. 1. FIG. 2 is a perspective view illustrating the sheet feeding apparatus 2 according to the present embodiment. FIG. 3 is a perspective view illustrating a separation feeding unit 21 in the sheet feeding apparatus 2 according to the present embodiment. FIG. 4 is a sectional view of a feeding roller 22 in the sheet feeding apparatus 2 according to the first embodiment. FIGS. 5A and 5B are perspective views illustrating a roller dumper 8 in the sheet feeding apparatus 2 according to the first embodiment.

As illustrated in FIG. 2, the sheet feeding apparatus 2 is provided with a sheet tray 20 which loads the sheets S, and the separation feeding unit 21 which separates and feeds the sheets S loaded in the sheet tray 20.

The sheet tray 20 is provided with a lifting/lowering mechanism (not illustrated) which is capable of freely lifting and lowering the loaded sheets S, and at the time of feeding the sheets S, the lifting/lowering mechanism lifts the sheets S so as to press the uppermost sheet of the stored sheets S against the after-mentioned feeding roller 22.

As illustrated in FIG. 3, the separation feeding unit 21 is provided with the feeding roller 22 which feeds the sheets stored in the sheet tray 20 toward the image forming portion 3, a separation roller 23 which separates the sheets S, fed by the feeding roller 22, one by one, and a torque limiter 24. Further, the separation feeding unit 21 is provided with a driving motor M for rotating the feeding roller 22 and the separation roller 23, and a drive transmission mechanism 6 which transmits driving force from the driving motor M to the feeding roller 22 and the separation roller 23.

As illustrated in FIG. 4, the feeding roller 22 is provided with a rubber roller portion 22*a* which is pressed against the uppermost sheet S stored in the sheet tray 20 to feed it, and a color portion 22*b* which supports the rubber roller portion 22*a*. The color portion 22*b* is provided with a shaft bearing portion 22*c* which rotatably supports an after-mentioned feeding rotational shaft 62, and a dumber storing portion 22*d* which is fitted with the after-mentioned roller dumper 8 to store the roller dumper 8. Further, as illustrated in FIG. 5, the dumber storing portion 22*d* is provided with drive transmission ribs 22*e*, 22*e* which are engaged with after-mentioned drive transmission grooves 8*b*, 8*b* of the roller dumper 8. The drive transmission rib 22*e* is provided with dropping preventive projections 22*f*, 22*f* which are pressed into the drive transmission groove 8*b* so as to prevent the roller dumper 8 from dropping.

The separation roller 23 is pressed against the feeding roller 22 to form a nip portion with the feeding roller 22, and when a plurality of sheets is fed by the feeding roller 22, the separation roller 23 rotates in the reverse direction to the feeding direction, to separate the plurality of sheets S one by one and feed only the uppermost sheet S. Specifically, the separation roller 23 is applied with rotational drive in the reverse direction to the feeding direction via the torque limiter 24. When one sheet S is sent to the nip portion, the drive is blocked off by the torque limiter 24, and the separation roller 23 rotates as driven by the feeding roller 22. On the other hand, when two or more sheets S are sent to the nip portion, since a coefficient of friction between the sheets is smaller than a coefficient of friction between the separation roller 23 and the sheet S, the separation roller 23 rotates in the reverse direction to the feeding direction, to pull second and subsequent sheets back. Moreover, the separation roller 23 is swingably supported by a separation roller pressurizing arm 26 and a separation roller pressurizing spring 27 with a swinging fulcrum taken as a roller shaft bearing 25, and is pressed against the feeding roller 22.

The drive transmission mechanism 6 is provided with a feeding clutch 60 connected to the driving motor M, a feeding gear 61 connected to the feeding clutch 60, the feeding rotational shaft 62 connected to the feeding gear 61, a pin 7 having been pressed into the feeding rotational shaft 62, and the roller dumper 8 as a vibration absorbing member. Via these, the drive transmission mechanism 6 transmits rotational driving force of the driving motor M to the feeding roller 22, to rotate the feeding roller 22 in the feeding direction.

Herein, as illustrated in FIG. 5A, the roller dumper 8 is formed in a shape of an elastically transformable substantially circular plate, and, for example, it can be an elastic member formed of a viscoelastic material, namely a rubber material, with a rubber hardness of degree 30° to 60°.

Further, as illustrated in FIG. 5B, one surface of the roller dumper 8 is formed with the drive transmission grooves 8*b*, 8*b* fittable with the drive transmission ribs 22*e*, 22*e* of the feeding roller 22 as fitting portions, and a plurality of transformed grooves 8*e*. The drive transmission ribs 22*e*, 22*e* are formed so as to extend in a radial direction from the center of rotation of the feeding roller 22, and the drive transmission grooves 8*b*, 8*b* are also formed so as to extend from the radial direction from the center. The roller dumper 8 can absorb vibrations of the feeding roller 22 by the drive transmission ribs 22*e*, 22*e* being elastically transformed at the time of being fitted with the drive transmission grooves 8*b*, 8*b*, and can more effectively absorb vibrations of the feeding roller 22 by the plurality of transformed grooves 8*e* being transformed. Similarly, the other-side surface of the roller dumper 8 is formed with drive transmission grooves 8*a*, 8*a*, which are fitted with tip portions 7*a*, 7*a* of the pin 7 having been pressed into the feeding rotational shaft 62, and the plurality of transformed grooves 8*e*. The drive transmission grooves 8*a*, 8*a* are elastically transformed at the time of being fitted with the tip portions 7*a*, 7*a* of the pin 7, whereby the roller dumper 8 absorbs vibrations of the feeding roller 22 so as to prevent the vibrations from transmitting to the feeding rotational shaft 62 via the pin 7. The plurality of transformed grooves 8*e* is then transformed, thereby to make vibrations of the feeding roller 22 efficiently absorbable.

Further, the roller dumper 8 is formed with a through hole 8*c*, through which the feeding rotational shaft 62 is allowed to pass, such that a space is provided between the through hole 8*c* and the feeding rotational shaft 62, and by providing the space, it is possible to block off vibrations in a rotating direction between the feeding roller 22 and the feeding rotational shaft 62.

Moreover, the drive transmission mechanism 6 is provided with a gear train 63 as a drive transmitting unit connected to the feeding rotational shaft 62, and a separation rotational shaft 64 which is connected to the gear train 63 and connected to the separation roller 23 via the torque limiter 24. That is, the gear train 63 is provided between the feeding rotational shaft 62 and the separation rotational shaft 64. Via these, the drive transmission mechanism 6 transmits rotational driving force of the driving motor M to the separation roller 23, and transmits rotational force to the separation roller 23 in the reverse direction to the feeding direction.

Moreover, the drive transmission mechanism 6 is provided with a tray clutch 65 connected to the driving motor M, a lifting/lowering cam 66 connected to the tray clutch 65, a lifting/lowering arm 67 interlocked with the lifting/lowering cam 66, and a tray pressurized arm 69 pressurized by a tray pressurizing spring 68. Via these, the drive transmission mechanism 6 converts the rotational driving force of the driving motor M to a vertical operation, to drive the lifting/lowering mechanism of the sheet tray 20. Specifically, pressure is applied to or released from the feeding roller 22 of the sheet tray 20 by the vertical operation of the tray pressurized arm 69. Further, a sensor (not illustrated) is fixed to the lifting/lowering cam 66, and a rotational phase of the lifting/lowering cam 66 is detected by the sensor, to perform on/off control of the tray clutch 65, whereby pressure is applied to or released from the feeding roller 22. It is to be noted that a roller 67*a* is fixed to the tip of the lifting/lowering arm 67, and the roller 67*a* reduces a drive transmission loss.

Next, a vibration preventive effect of the sheet feeding apparatus 2 in the image forming apparatus 1 according to the first embodiment will be described with reference to FIGS. 6A to 6D. FIGS. 6A to 6D are diagrams for describing a vibration preventing effect of the sheet feeding apparatus 2 according to the first embodiment.

Figure 6A:
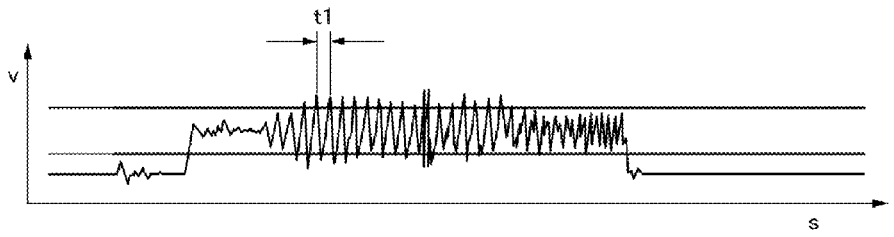
FIGS. 6A to 6D are diagrams for describing a vibration preventing effect of the sheet feeding apparatus according to a first embodiment.
Figure 6B:
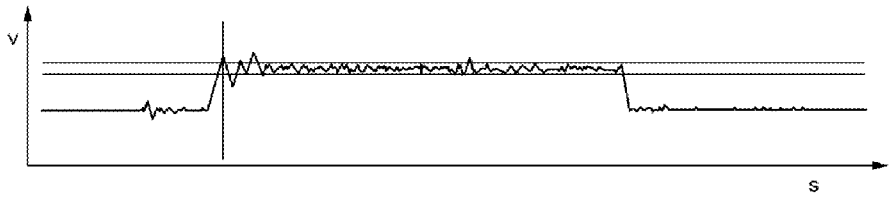

FIGS. 6A and 6B illustrate a surface speed waveform (vibration waveform) of the feeding roller 22 in the rotating direction, where a horizontal axis indicates time (s) and a vertical axis indicates a surface speed (v) of the feeding roller 22.

FIG. 6A illustrates a vibration waveform of a conventional feeding roller in the rotating direction, illustrating a case where sheets are fed in a bunch to the nip portion between the feeding roller and the separation roller, and vibrations of a second sheet are propagated to the feeding roller, causing vibrations of the feeding roller at tens Hz and generation of noise. On the other hand, FIG. 6B illustrates a vibration waveform of the feeding roller 22 according to the first embodiment in the rotating direction, illustrating a case where, even when sheets are fed in a bunch to the nip portion between the feeding roller 22 and the separation roller, vibrations of the second sheet are not propagated to the feeding roller, not causing generation of noise.

As illustrated in FIGS. 6A and 6B, in the conventional feeding roller, when sheets are fed in a bunch to the nip portion, the second sheet vibrates to generate noise, but by providing the roller dumper 8, transmission of vibrations of the second sheet to the feeding roller 22 is suppressed, to allow reduction in noise.

Figure 6C:
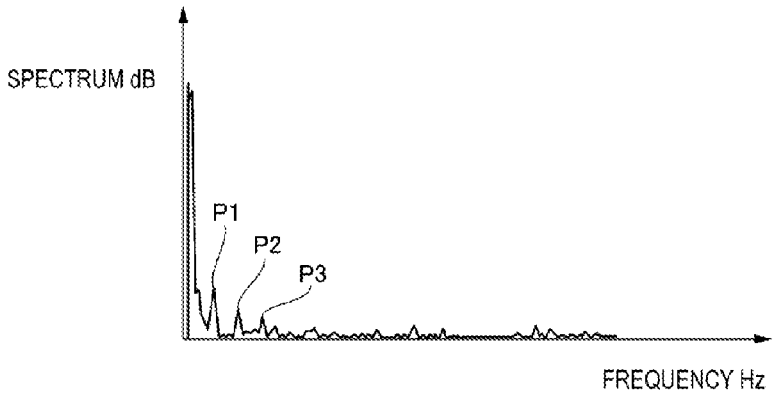
Figure 6D:
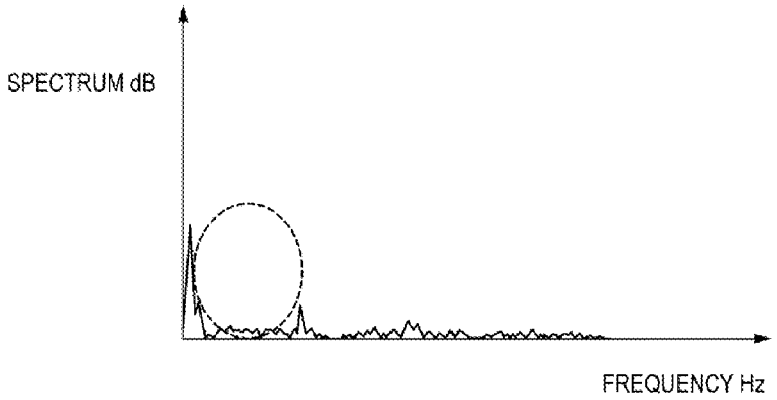

FIGS. 6C and 6D illustrate spectrums dB of noise generated at the time of feeding sheets, where a horizontal axis indicates a frequency (Hz) and a vertical axis indicates a spectrum (dB). FIG. 6C is the case of using the conventional feeding roller, illustrating a frequency spectrum of noise at the time when vibrations of the feeding roller in the rotating direction are being generated as in FIG. 6A. Herein, an amplitude t1 illustrated in FIG. 6A and a peak frequency P1 of a first noise illustrated in FIG. 6C is in a relationship of P1=1/t1.

Further, peak frequencies P2 and P3 of second and third noises illustrated in FIG. 6C are integral multiples of the peak frequency P1 of the first noise. On the other hand, FIG. 6D is the case of using the roller dumper, and illustrates a frequency spectrum dB at the time when rotational vibrations of the feeding roller 22 in the rotating direction have been stopped as illustrated in FIG. 6B. In FIG. 6D, the peak frequencies P1, P2, P3 of the first to third noises illustrated in FIG. 6C are not present, and hence it is found that the noise has been reduced.

As thus described, the roller dumper 8 for suppressing vibrations is provided between the feeding rotational shaft 62 and the feeding roller 22, thereby allowing suppression of noise associated with separation and feeding of sheets, without affecting sheet separation performance and a load on a sheet feeding drive. Further, since the configuration formed only by providing the roller dumper 8, it is possible to suppress noise without making the configuration of the sheet feeding apparatus complex.

Second Embodiment

Next, an image forming apparatus 1A according to a second embodiment of the present invention will be described with reference to FIGS. 7, 8A, and 8B. The image forming apparatus 1A according to the second embodiment is different from the first embodiment in a roller dumper in a sheet feeding apparatus 2A. For this reason, in the second embodiment, a description will be given with a focus on the different respect from the first embodiment, namely the roller dumper, and descriptions of similar configurations to those of the first embodiment are provided with the same numerals and descriptions thereof are omitted.

Figure 7:
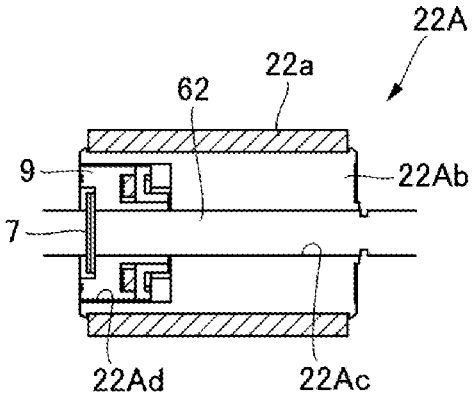
FIG. 7 is a sectional view of a feeding roller in a sheet feeding apparatus in an image forming apparatus according to a second embodiment.
Figure 8A:
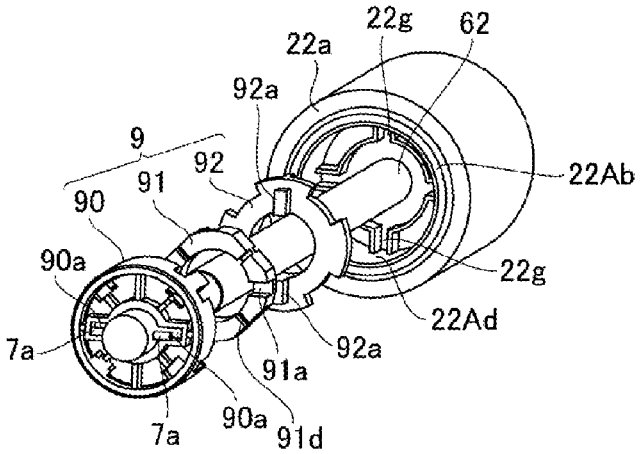
FIGS. 8A and 8B are perspective views illustrating a dumper unit in a sheet feeding apparatus according to the second embodiment.
Figure 8B:
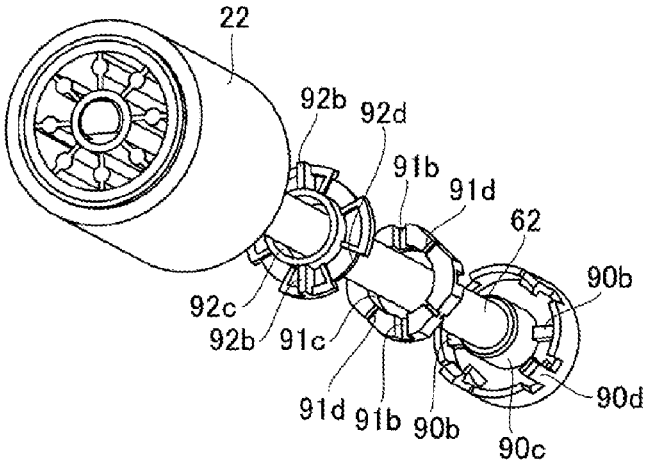

FIG. 7 is a sectional view of a feeding roller 22A in the sheet feeding apparatus 2A in the image forming apparatus 1A according to the second embodiment. FIGS. 8A and 8B are perspective views illustrating a dumper unit 9 in the sheet feeding apparatus 2A according to the second embodiment.

As illustrated in FIG. 1, the image forming apparatus 1A is provided with the sheet feeding apparatus 2A, the image forming portion 3, the fixing portion 4 and the discharge portion 5. As illustrated in FIG. 2, the sheet feeding apparatus 2A is provided with the sheet tray 20 and a separation feeding unit 21A. As illustrated in FIG. 3, the separation feeding unit 21A is provided with the feeding roller 22A, the separation roller 23, the torque limiter 24, the driving motor M, and a drive transmission mechanism 6A.

As illustrated in FIG. 7, the feeding roller 22A is provided with the rubber roller portion 22*a*, and a color portion 22Ab which supports the rubber roller portion 22*a*. The color portion 22Ab is provided with a shaft bearing portion 22Ac which supports the feeding rotational shaft 62, and a dumper storing portion 22Ad which is engaged with the after-mentioned dumper unit 9 to store it. As illustrated in FIGS. 8A and 8B, the dumper storing portion 22Ad is provided with drive transmission grooves 22*g*, 22*g* which are fitted with after-mentioned drive transmission ribs 92*b*, 92*b* of the dumper unit 9.

The drive transmission mechanism 6A is provided with the feeding clutch 60, the feeding gear 61, the feeding rotational shaft 62, the pin 7, and the dumper unit 9. Via these, the drive transmission mechanism 6A transmits rotational driving force of the driving motor M to the feeding roller 22A, to rotate the feeding roller 22A in the feeding direction.

The dumper unit 9 is configured including a first dumper color 90, an elastically transformable feeding roller dumper 91, and a second dumper color 92. The first dumper color 90 has a shaft bearing portion 90*c* which rotatably supports the feeding rotational shaft 62, and the one-side surface of the first dumper color 90 is formed with drive transmission grooves 90*a*, 90*a*, which are fitted with the tip portions 7*a*, 7*a* of the pin 7 having been pressed into the feeding rotational shaft 62. Further, the other surface of the first dumper color 90 is formed with drive transmission ribs 90*b*, 90*b*, which are fitted with a feeding roller dumper 91.

The feeding roller dumper 91 is arranged on the other surface side of the first dumper color 90, and has a shaft bearing portion 91*c* engaged with the shaft bearing portion 90*c* of the first dumper color 90. Further, the one-side surface of the feeding roller dumper 91 is formed with drive transmission ribs 91*a*, 91*a*, which are fitted with the drive transmission ribs 90*b*, 90*b* of the first dumper color 90, and transformed grooves 91*d*, 91*d*. Moreover, the other-side surface of the feeding roller dumper 91 is formed with drive transmission grooves 91*b*, 91*b*, which are fitted with the second dumper color 92, and the transformed grooves 91*d*, 91*d*.

The second dumper color 92 is arranged on the other surface side of the feeding roller dumper 91, and has a shaft bearing portion 92*c* engaged with the shaft bearing portion 90*c* of the first dumper color 90. Further, the one-side surface of the second dumper color 92 is formed with drive transmission ribs 92*a*, 92*a*, which are fitted with the drive transmission ribs 91*b*, 91*b* of the feeding roller dumper 91. Moreover, the other-side surface of the second dumper color 92 is formed with drive transmission ribs 92*b*, 92*b*, which are fitted with the drive transmission ribs 22*g*, 22*g* of the feeding roller 22A.

Furthermore, the dumper unit 9 is integrated by arranging the feeding roller dumper 91 between the first dumper color 90 and the second dumper color 92 and locking four locking projections 90*d* of the first dumper color 90 to four locked portions 92*d* of the second dumper color 92.

As thus described, the feeding roller dumper 91 of the dumper unit 9 is elastically transformed, thereby to absorb vibrations in the rotating direction, and a plurality of transformed grooves 91*d* is transformed, thereby to further effectively absorb vibrations. This can result in suppression of vibrations in the rotating direction between the feeding roller 22A and the feeding rotational shaft 62. Further, with the dumper being unitized, for example, it needs not be exchanged simultaneously with the feeding roller 22A as a consumable component, thereby allowing reduction in service cost as well as running cost.

While the embodiments of the present invention have been described above, the present invention is not restricted thereto. Further, the effects described in the embodiments of the present invention are only the most preferred effects resulting from the present invention, and the effects of the present invention are not restricted to those described in the embodiments thereof.

For example, while the description was given using the roller dumper 8 (dumper unit 9) as the vibration absorbing member in the present embodiment, the present invention is not restricted thereto. The vibration absorbing member may, for example, be configured to be provided with one or more than one soft-viscous vibration-proof members (for example, vibration-proof rubber, etc.).

Moreover, while the description has been given in the present embodiment using the gear train 63 as the drive transmitting unit for converting the rotational driving force of the driving motor M to rotational driving force in the reverse direction to the feeding direction and transmitting the converted force to the separation rotational shaft 64, the present invention is not restricted thereto. The drive transmitting unit may, for example, be configured such that the rotational driving force is transmittable by a belt.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-184434, filed Aug. 23, 2012, which is hereby incorporated by reference herein in its entirety.

What is claimed is:

1. A sheet feeding apparatus, comprising:

a feeding roller which feeds a sheet;

a separation roller which is pressed against the feeding roller and rotates in a reverse direction to a direction of feeding by the feeding roller to separate sheets, fed by the sheet feeding roller, one by one;

a feeding rotational shaft which rotatably supports the feeding roller and to which is transmitted a rotational driving force from a driving motor; and a vibration absorbing portion which includes an elastic member formed of a rubber material and formed in a plate shape, wherein one surface of the plate shape of the elastic member has a first connected portion that is connected with a connect portion provided on the feeding roller and a side surface of the plate shape of the elastic member has a second connected portion that is connected with a connect portion provided on the feeding rotational shaft, and the vibration absorbing portion transmits the rotational driving force from the feeding rotational shaft to the feeding roller, while absorbing vibrations of the feeding roller by an elastic transformation of the rubber material.

2. The sheet feeding apparatus according to claim 1, wherein the elastic member has a through-hole through which the feeding rotational shaft is passed such that a space is provided between the through-hole and the feeding rotational shaft and is elastically transformable in a rotating direction of the feeding roller.

3. The sheet feeding apparatus according to claim 1, further comprising:

a separation rotational shaft which rotates the separation roller; and a drive transmitting unit which is provided between the feeding rotational shaft and the separation rotational shaft, and converts rotational driving force of the driving motor to rotational driving force in a reverse direction to the feeding direction, and transmits the converted force to the separation rotational shaft.

4. An image forming apparatus, comprising:

the sheet feeding apparatus according to claim 1; and an image forming portion which forms an image on a sheet fed by the sheet feeding apparatus.

5. The sheet feeding apparatus according to claim 1, wherein the first connected portion is connected with the connect portion of the feeding roller by an engaging a protrusion formed in a radial direction from a center of rotation of the feeding rotational shaft with a groove formed in a radial direction from the center of rotation of the feeding rotational shaft.

6. The sheet feeding apparatus according to claim 1, wherein the second connected portion is a groove formed on the elastic member in a radial direction from the center of rotation of the feeding rotational shaft and the connect portion is a pin fixed to the feeding rotational shaft to be engaged with the groove.

7. A sheet feeding apparatus comprising: a feeding roller which feeds a sheet;

a separation roller which is pressed against the feeding roller and rotates in a reverse direction to a direction of feeding by the feeding roller to separate sheets, fed by the sheet feeding roller, one by one;

a feeding rotational shaft which rotatably supports the feeding roller and is transmitted a rotational driving force from a driving motor; and a vibration absorbing portion which includes an elastic member and absorbs vibrations of the feeding roller while transmitting the rotational driving force from the feeding rotational shaft to the feeding roller, wherein the elastic member is formed in a shape of a substantially circular plate, and the elastic member has a through-hole through which the feeding rotational shaft is passed, a first connected portion that is connected with a connect portion provided on the feeding roller and a second connected portion that is connected with a connect portion provided on the feeding rotational shaft, and the first connected portion is connected with the connect portion of the feeding roller by engaging a protrusion formed in a radial direction from a center of rotation of the feeding rotational shaft with a groove formed in the radial direction from the center of rotation of the feeding rotational shaft.

8. The sheet feeding apparatus according to claim 7, wherein the connect portion provided on the feeding rotational shaft is a pin fixed to the feeding rotational shaft and the second connected portion provided on the elastic member is a groove formed in a radial direction from the center of rotation of the feeding rotational shaft to be engaged with the pin.

9. An image forming apparatus, comprising:

the sheet feeding apparatus according to the claim 7; and an image forming portion which forms an image to the sheet fed from the sheet feeding apparatus.

10. A sheet feeding apparatus comprising a feeding roller which feeds a sheet;

a separation roller which is pressed against the feeding roller and rotates in a reverse direction to a direction of feeding by the feeding roller to separate sheets, fed by the sheet feeding roller, one by one;

a feeding rotational shaft which rotatably supports the feeding roller and is transmitted a rotational driving force from a driving motor; and a vibration absorbing portion which includes an elastic member which is elastically transformable in a rotating direction of the feeding roller, a first dumping collar provided on the feeding rotational shaft and a second dumping collar provided on the feed roller, and wherein the elastic member is connected with each of the first dumping collar and the second dumping collar.

11. An image forming apparatus, comprising:

the sheet feeding apparatus according to the claim 10; and an image forming portion which forms an image to the sheet fed from the sheet feeding apparatus.

12. A sheet feeding apparatus, comprising:

a feeding roller which feeds a sheet;

a separation roller which is pressed against the feeding roller and rotates in a reverse direction to a direction of feeding by the feeding roller to separate sheets, fed by the sheet feeding apparatus, one by one;

a feeding rotational shaft which rotatably supports the feeding roller and is transmitted a rotational driving force from a motor; and a vibration absorbing portion which has an elastic member made of rubber material which is connected with each of the feeding roller and the feeding rotational shaft, and transmits the rotational driving force from the feeding rotational shaft to the feeding roller through the rubber material of the vibration absorbing member, wherein the elastic member has a connected portion that is connected with a connect portion provided on the feeding roller and the connected portion is a groove formed in a radial direction from the center of rotation of the feeding rotational shaft to be engaged with a pin fixed to the feeding rotational shaft.

13. The sheet feeding apparatus according to claim 12, further comprising;

a connected portion provided on the elastic member is connected with a connect portion of the feeding roller by engaging a protrusion formed in a radial direction from a center of rotation of the feeding rotational shaft with a groove formed in the radial direction from the center of rotation of the feeding rotational shaft.

14. The sheet feeding apparatus according to claim 12, wherein the elastic member has a through-hole through which the feeding rotational shaft is passed such that a space is provided between the through-hole and the feeding rotational shaft and is elastically transformable in a rotating direction of the feeding roller.

15. An image forming apparatus, comprising:

the sheet feeding apparatus according to the claim 12; and an image forming portion which forms an image to the sheet fed from the sheet feeding apparatus.

* * * * *